United States Patent [19]

Seidel et al.

[11] Patent Number: 4,607,490

[45] Date of Patent: Aug. 26, 1986

[54] HELIUM II PHASE SEPARATOR

[75] Inventors: Albert Seidel, Siegertsbrunn; Hartmut Neuking; Ernst Blenninger, both of Munich, all of Fed. Rep. of Germany

[73] Assignee: Messerschmitt-Bölkow-Blohm GmbH, Fed. Rep. of Germany

[21] Appl. No.: 731,108

[22] Filed: May 6, 1985

[30] Foreign Application Priority Data

May 9, 1984 [DE] Fed. Rep. of Germany ..... 3417055

[51] Int. Cl.[4] ..... F17C 7/02

[52] U.S. Cl. ..... 62/51; 62/514 R

[58] Field of Search ..... 62/45, 48, 514 R, 51, 62/50

[56] References Cited

U.S. PATENT DOCUMENTS

| | | | |
|---|---|---|---|
| 3,195,322 | 7/1965 | London | 62/514 R |
| 3,845,636 | 11/1974 | Van Mal et al. | 62/514 R |
| 4,223,723 | 9/1980 | Hilal | 62/514 R |
| 4,297,856 | 11/1981 | Staas et al. | 62/514 R |
| 4,498,046 | 2/1985 | Faris et al. | 62/514 R |
| 4,499,737 | 2/1985 | Binnig et al. | 62/514 R |

*Primary Examiner*—Ronald C. Capossela

*Attorney, Agent, or Firm*—McGlew and Tuttle

[57] ABSTRACT

A helium II phase separator reproducible in manufacture utilizes a thermo-mechanical effect and comprises a plurality of adjacent passage gaps of identical width which are provided in the walls of a cavity dipped into a bath of liquid helium, so that the gaseous helium can be taken off.

15 Claims, 7 Drawing Figures

FIG. 3
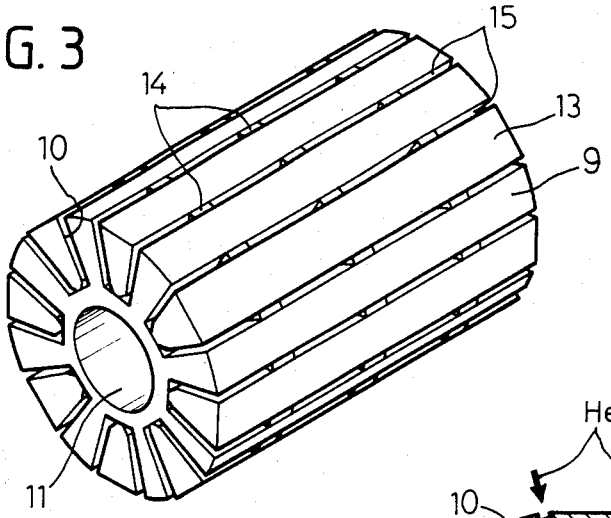
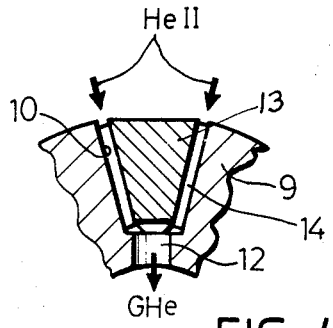
FIG. 4
FIG. 5
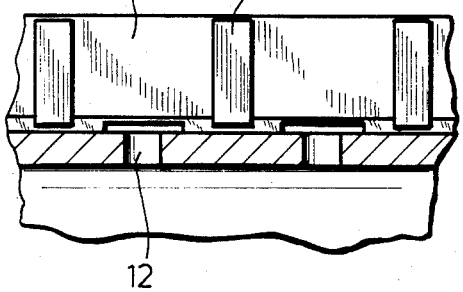
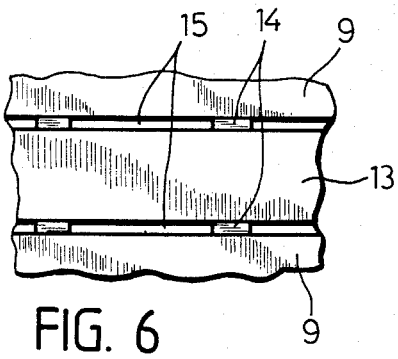
FIG. 6
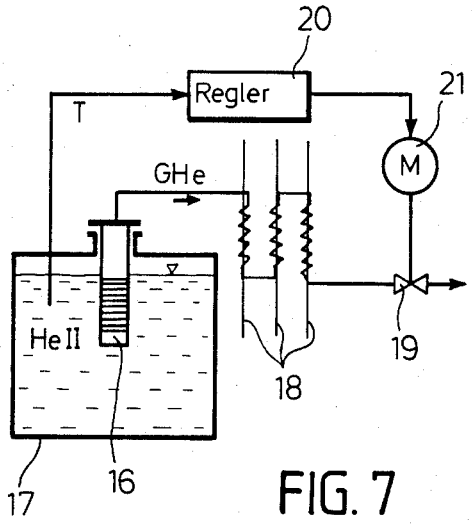
FIG. 7

HELIUM II PHASE SEPARATOR

FIELD AND BACKGROUND OF THE INVENTION

This invention relates in general to liquid and gas separators and in particular to a new and useful helium II phase separator.

A phase separator for helium II, particularly under zero-gravity conditions, is described, for example, in the Research Report W-79-47, Free University Berlin, by H. D. Denner et al, December 1979. To separate superfluid helium (helium II) from the gaseous phase, the thermo-mechanical effect (fountain effect) is utilized. With two liquid vessels connected to each other through a capillary system, this effect becomes manifest by a rise of the level at the warmer side. This effect can be observed even if gaseous helium is provided at one side of the capillary system. With the temperature of the liquid bath exceeding that of the capillary system at the side of the gas phase, and with suitably selected boundary conditions, the liquid cannot pass, due to the thermo-mechanical effect of the capillary system, since the respective force is opposite to the temperature gradient thus directed from the exit side to the liquid bath. Such a system may therefore be employed as a phase separator for helium II. The low temperature at the exit side is obtained by lowering the pressure, for example by pumping, so that the liquid cools down by evaporation. Under outer space conditions, this is obtained simply by providing a throttling valve in the gas outlet line through which the helium escapes into the outer space (vacuum). A prior art capillary system suitable for producing the thermo-mechanical effect substantially comprises a plug of a tightly wound aluminum foil having a spiral passage opening, which is inserted in a holder of a thermally well-conducting material and connected therethrough to the gas system. With such a plug, however, strictly speaking, not one, but a plurality of slot-like openings is formed which are irregular and extend spirally adjacent to each other. At the same time, the winding must be tight enough to obtain a maximum slot clearance of about 10 micrometers, since otherwise the thermo-mechanical effect does not occur and liquid helium would escape. Passage openings of this kind are not reproducible, so that always a plurality of plugs of this kind must be fabricated and tested for usefulness.

It is further known from the above cited Report that the thermomechanical effects may also be obtained with narrow annular gaps having a width of about 10 micrometers or less. However, tests have shown that while utilizing the thermo-mechanical effect only for phase separation, the rate of flow of helium through a narrow annular gap is relatively low. With rates of helium flow of about 45 mg/sec. typical for outer space tests, an annular gap having a diameter of about 0.8 meters would be needed for a gap width of about 10 micrometers. Such annular gaps can hardly be produced and are unsuitable for application in space vehicles.

In accordance with the invention a helium II phase separator for use with a bath of liquid helium comprises a member which is insertable into the bath and which has a gas takeoff line for taking off a gaseous helium. The device includes an arrangement of cylindrical members which is disposed in the liquid helium so as to define a plurality of substantially equal flow area passageways connected to the gas takeoff line. In one embodiment the passageway is defined by ring-like square plates which have spaces therebetween. The plates and spaces are dimensioned so that they provide uniform passageways which connect to a central area enclosed by the plates and a centrally disposed displacement body which connects to a gas takeoff line. Advantageously the gas takeoff line comprises a coil member engaged around the cylindrical body and the plates which extend through the cylindrical body into the space for the collection of the gases helium at its one end and to an outlet at its opposite end.

The plates and the spaces defined are substantially equal passageways for the flow of the gaseous helium. In the first embodiment and in another embodiment the equal passageways are defined by a cylindrical body having circumferentially spaced V-shaped grooves which are filled by wedge-shaped inserts precisely positioned so as to define substantially uniform gaps between the inserts and the grooves which connect to a takeoff line for gaseous helium.

Accordingly it is an object of the invention to provide an improved device for the phase separation of helium II which includes a member which is insertable into a liquid helium bath and has a plurality of slot-shaped passage gaps arranged to utilize a thermo-mechanical effect and being of substantially identical flow area and provided in a member which is insertable in the bath of liquid helium.

A further object of the invention is to provide a helium II phase separator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is a top side perspective view of a cylindrical hollow body embodiment having axially extending grooves;

FIG. 4 is a cross-sectional detail corresponding to FIG. 3;

FIG. 5 is a partial longitudinal sectional view corresponding to FIG. 3;

FIG. 6 is a partial top plan view corresponding to FIG. 3; and

FIG. 7 illustrates an arrangement of a helium II phase separator on a helium II cryostat, with a flow rate control.

DESCRIPTION OF THE PREFERRED EMBODIMENTS

Figure 1:
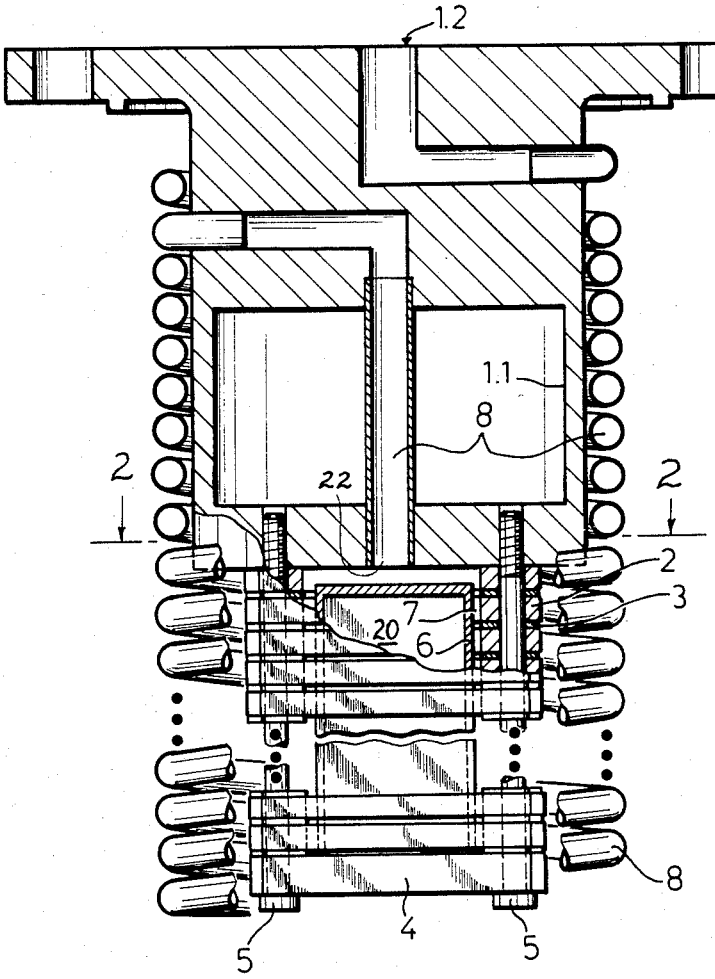
FIG. 1 is a partly sectional and side elevational view of a helium II phase separator built up of superposed ring-like square plates.

Referring to the drawings in particular the invention embodied therein comprises a helium II phase separator for use with a bath of liquid helium such as a bath 17 shown in FIG. 7 and which comprises a member generally designated 1 in FIG. 1 which is insertable in the bath and has a gas takeoff line 8 for the taking off of the gaseous helium. Wall means associated with the member 1 an inner cylindrical displacement body 6, and comprises in the embodiment of FIG. 1 a plurality of ring-shaped square plates 2 which are separated by similarly shaped spacers and which define a plurality of substantially equal flow area passageways 7 connected to a coiled gas takeoff line 8.

Figure 2:
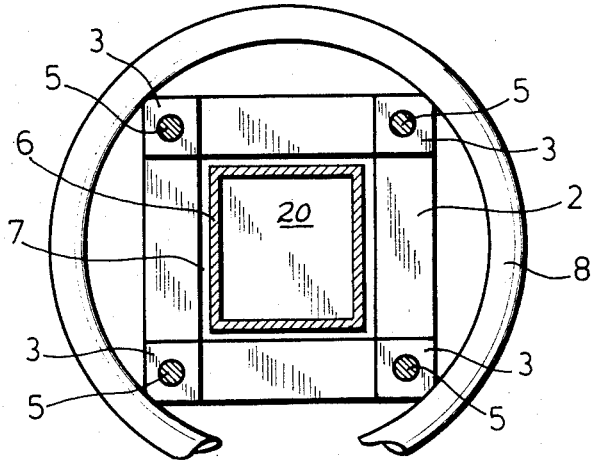
FIG. 2 is a sectional view taken along line 2—2 of FIG. 1.

The phase separator shown in FIG. 1 substantially comprises a flanged cylindrical body 1 to be secured to and protrude into a tank (17 in FIG. 7) and which is filled with helium II and forms a part of a cryostat. To the end front side of a cylindrical portion 1.1 of flanged body 1, a stack of ring-like square plates 2 is secured. The individual plates are spaced from each other by means of spacers 3. At its end protruding deepest into the tank, the stack is tightly closed by means of a cover plate 4 through which anchoring bolts 5 extending also through the entire stack are passed to secure the stack to the flanged body 1 under elastic biasing stress. The inside of the stack forms a cavity 20 (see FIG. 2) which is bounded at the bottom by cover plate 4 and into which a displacement body 6 connected to cover plate 4 projects, so that a cup-shaped gap 7 is left free between the inner edges of square plates 2, the cylindrical portion of flanged body 1, and the displacement body 6. This cup-shaped gap 7 communicates with a central inlet 22 of a line 8 for the separated gas, which line passes through flange body 1 to the circumference thereof and then winds about the cylindrical portion 1.1 of the flange body 1, and the stack of plates 2 down and up, thus forming a heat exchanger, to finally enter again into body 1 and form a central outlet 1.2 therefrom The gaps between the superposed square plates 2 have a width of about 10 micrometers. This width may range between 5 and 15 micrometers and is exaggerated about 200 times in FIG. 1. Square plates 2 have a particularly fine surface finish; the surface waviness should be less than 1 micrometer. With square plates 2 having an outer dimension of 50 mm, inner dimension of 30 mm, and spacers 3 being spaced from each other by 30 mm. A rate of flow of 45 mg/sec would require, in this embodiment, a total of 21 superimposed plates, which, with an assumed thickness of 2 mm of a plate, would result in an overall height of the stack of only about 42 mm.

The separator operates as follows:

Between every two ring-like plates 2 vertically spaced by square spacers 3 provided in the corners, four passage gaps are formed permitting an only two-dimensional flow of helium therethrough. The width of the gaps is uniform and dimensioned to produce, under corresponding boundary conditions, the thermomechanical effect by which superfluid helium (helium II) is prevented from passing therethrough. Therefore, only gaseous helium flows through the cup-shaped connecting gap 7, to be taken off through the gas line 8. Through this line 8 designed as a heat exchanger, the residual cold of the gaseous helium is recovered.

The helium II phase separator shown in FIG. 3 comprises a cylindrical hollow body 9, which in a similar way as the square plates of the embodiment of FIG. 1, is secured to a flanged body (not shown) including a central gas inlet and outlet. Hollow body 9 is provided with V grooves 10 which are distributed over the outer circumference and extend in the axial direction of the body and communicate with the inside cavity 11 through bores 12 (see FIGS. 4 and 5). V-section inserts or strips 13 are centrally received in grooves 10 and held in a central position by spacers 14 (see FIG. 6), so that two opposite rows of identical slot-like passage gaps 15 are formed in each of the grooves (see FIGS. 4,5 and 6). As according to FIG. 1, cavity 11 is gas-tightly closed at the side remote from the flanged body, by a cover plate similar to cover plate 4, to which, still in accordance with FIG. 1, a cylindrical displacement body similar to hollow body 6 may be secured, to produce a cup-shaped collecting gap 15 for the helium.

Thickness and spacing of spacers 14, thus the geometry of the passage gaps, correspond to those of the embodiment of FIG. 1. Therefore, the gas flow is also purely two-dimensional. The V grooves and strips with angularly identical cross sections have the advantage that the width of the passage gaps can be adjusted by adjusting the strips in depth.

FIG. 7 shows diagrammatically the positioning of a phase separator according to FIGS. 1 or 3, in a tank 17 filled with helium II, of a cryostat. The gaseous helium (GHe) taken off is used for cooling the radiation shields 18 of the cryostat, and is then directed through a control valve 19 to a vacuum pump, or into the vacuum of the outer space. The mass flow of the helium is controlled by varying the differential pressure between the inlet and outlet of the passage gaps, in a manner such that at the predetermined bath termperatures, the thermomechanical effect is maintained. To this end, the control valve 19 is utilized which is provided outside the helium II cryostat and is in turn controlled by a motor 21 through a controller 20. The controlled variable is the temperature of the helium II bath. This temperature must be controlled very sensitively, especially in tests in outer space. As soon as the helium II bath temperature starts to rise, the control valve opens, so that the differential pressure in the passage gaps of separator 16 increases. This in turn increases the rate of flow of the helium, the bath temperature drops again and the action is reversed.

While specific embodiments of the invention have been shown and described in detail to illustrate the application of the principles of the invention, it will be understood that the invention may be embodied otherwise without departing from such principles.

What is claimed:

1. Helium II phase separator for use with a bath of liquid helium, comprising a member insertable into the bath, said member having a portion with spaced-apart plate members defining a plurality of substantially equal flow area passageways, and a gas take-off line connected to said member for the taking off of of gaseous helium being connected to said equal flow area passageways.

2. A helium phase separator according to claim 1, wherein said flow passage gaps are substantially uniformly dimensioned to prevent substantial superfluid helium from passing therethrough.

3. A helium II phase separator according to claim 1, wherein said passageways are of slot-shaped formation arranged to utilize a thermo-mechanical effect in the separation of the helium phases, wherein said member has a cavity connected to a gas takeoff line and that said passageways define passge gaps which permit only two-dimensional flow.

4. A helium II phase separator according to claim 2, wherein each of said passageways are formed by two planar wall portions of said wall means extending parallel to each other and spaces arranged between said planar wall portions of definite thickness.

5. A helium II phase separator according to claim 3, wherein said passage means comprises a plurality of ring-like plate members having spacers therebetween forming said passageways.

6. A helium II phase separator according to claim 4, wherein said ring-like plates are square plates.

7. A helium II phase separator according to claim 5, including a plurality of anchoring rods interconnecting said plates, biasing said plates and said spacers together.

8. A helium II phase separator according to claim 1, wherein said member comprises a cylindrical member having a central cavity, a stack of plate rings alternately arranged with spacers secured to said cylindrical body, a cover plate for said stack arranged below the lowermost plate connected to said body and enclosing a hollow space within said stack of plates, a displacement body secured to said cover plate being spaced from the inside of said ring-shaped plates and defining a gaseous flow area therein from the space between said plates to said gas takeoff line.

9. A helium II phase separator according to claim 1, wherein said wall means comprises a cylindrical body having a cylindrical surface with a plurality of V shaped circumferentially spaced grooves defined therearound, strip members disposed in said grooves and defining between said grooves and said strip members said passageway.

10. A helium II phase separator according to claim 9 including a spacer member disposed between each side of said groove and strips forming passage gaps on each side of said grooves.

11. A helium II phase separator according to claim 10 wherein said grooves and said strips have V shaped cross section with identical radial angles.

12. A helium II phase separator according to claim 1 wherein parallel to the inside wall surface of said cavity another wall is provided and forming a helium collecting passage between said another wall and said inside wall surface for taking off gaseous helium, the dimension of said collecting passage transversely to the gas flow direction exceeding that of the passage gaps.

13. A helium II phase separator according to claim 12, including a heat exchanger having a liquid helium therein adjacent said separator the gaseous helium being taken off the cavity through said heat exchanger and being in thermal contact with the liquid helium.

14. A helium phase separator, comprising a closed cylindrical body, the stack of alternately arranged ring-shaped rings and spaces secured to an end of said cylindrical body, the cover covering the exterior of said plates, anchor bolt means extending through said cover and said plate securing said cover and said plates to said body and forming a cavity at the interiors of said plate, said spacers, and said cover, a displacement body in the cavity connected to said cover and defining within said cavity a cup-shaped gap, a gas take-off line for recovering the residual cold of the gas helium having a central inlet extending through said cylindrical body and into said cup-shaped gap and a portion wound around said cylindrical body forming a heat exchange area, and having an outlet at the end of said cylindrical body opposite to said stack of ring-shaped plates and spaces, said spaces being arranged at spaced circumferential locations and defining flow passages therebetween and between said plates permitting only two-dimensional helium flow therebetween.

15. A helium phase separator comprising a closed container, a cylindrical core member in said container having radially extending slots at spaced locations around its circumference and defining flow passage gaps of substantially uniform dimension, said core member having a central bore flow passage with at least one connection to each of said radially extending slot, all of said slots defining flow passage gaps which are substantially uniformly dimensioned to prevent substantial superfluid helium from passing therethrough.

* * * * *